US006467202B1

(12) United States Patent
Brown, Jr.

(10) Patent No.: US 6,467,202 B1
(45) Date of Patent: Oct. 22, 2002

(54) DYNAMICALLY ACTIVE DIPPER DOOR MECHANISM

(75) Inventor: Robert F. Brown, Jr., Racine, WI (US)

(73) Assignee: Bucyrus International, Inc., South Milwaukee, WI (US)

( * ) Notice: Subject to any disclaimer, the term of this patent is extended or adjusted under 35 U.S.C. 154(b) by 0 days.

(21) Appl. No.: 09/606,699

(22) Filed: Jun. 29, 2000

Related U.S. Application Data

(60) Provisional application No. 60/142,018, filed on Jul. 1, 1999.

(51) Int. Cl.[7] ..... E02F 3/40

(52) U.S. Cl. ..... 37/445; 37/398; 414/726

(58) Field of Search ..... 37/444, 445, 398, 37/394; 414/726

(56) References Cited

U.S. PATENT DOCUMENTS

| | | | | |
|---|---|---|---|---|
| 1,629,634 A | | 5/1927 | Orndorff | |
| 1,712,040 A | | 7/1927 | Houghton | |
| 2,434,902 A | | 1/1948 | Burdick | |
| 3,208,610 A | * | 9/1965 | Logus | |
| 3,209,474 A | * | 10/1965 | Artman | |
| 3,341,041 A | * | 9/1967 | Salna | |
| 3,807,589 A | * | 4/1974 | Shovick | 37/444 |
| 3,869,054 A | * | 3/1975 | Moreau | |
| 4,006,832 A | | 2/1977 | Auxer et al. | |
| 4,063,373 A | | 12/1977 | Greer et al. | 37/115 |
| 4,565,485 A | * | 1/1986 | Wilman | 414/726 |
| 5,142,779 A | * | 9/1992 | LaBounty | 144/24.12 |
| 5,590,482 A | | 1/1997 | Peterson et al. | 37/403 |
| 5,613,308 A | | 3/1997 | Little | 37/445 |
| 5,813,822 A | * | 9/1998 | Pisco | 294/104 |
| 5,815,958 A | | 10/1998 | Olds et al. | 37/444 |
| 5,815,960 A | | 10/1998 | Soczka | 37/445 |
| 5,940,996 A | * | 8/1999 | Cummings | 37/444 |
| 5,974,705 A | | 11/1999 | Isley et al. | 37/444 |
| 6,108,945 A | * | 8/2000 | Cronk, Jr. | 414/726 |
| 6,301,809 B1 | * | 10/2001 | Staggs, Jr. | 37/444 |

FOREIGN PATENT DOCUMENTS

| | | |
|---|---|---|
| DE | 697 260 C | 10/1940 |
| DE | 10 41 877 B | 10/1958 |
| DE | 34 02 269 A | 8/1985 |
| WO | 97 41312 A | 11/1997 |

* cited by examiner

*Primary Examiner*—Robert E. Pezzuto
*Assistant Examiner*—Nathan Mammen
(74) *Attorney, Agent, or Firm*—Quarles & Brady LLP

(57) ABSTRACT

A dipper door pivotally mounted to a dipper is controlled as it pivots between open and closed positions. In one embodiment, the door is controlled by a brake pivotally linking the door to the dipper. In another embodiment, the door is pivotally mounted to the dipper by a pin, and the door is controlled by a linkage actuated by a linear actuator. The pivot point of the door is positioned above the dipper bottom to decrease the dump height of the dipper.

3 Claims, 7 Drawing Sheets

DYNAMICALLY ACTIVE DIPPER DOOR MECHANISM

CROSS REFERENCES TO RELATED APPLICATIONS

This application claims priority to provisional U.S. Patent Application No. 60/142,018 filed on Jul. 1, 1999.

STATEMENT REGARDING FEDERALLY SPONSORED RESEARCH

Not Applicable

BACKGROUND OF THE INVENTION

This invention relates to dippers for large shovels, and particularly to a mechanism for controlling the position of the dipper door that normally closes the bottom of the dipper.

Shovel dippers are formed with teeth at their leading edge and a dipper door that normally closes the rear of the dipper to hold earth and other materials that are loaded into the dipper by the action of the shovel. The dipper door must be held closed while the dipper is being loaded and while the load in the dipper is swung to a deposit point. At that point, the dipper door must be opened to allow the contents of the dipper to fall out. Typically, the locking of the dipper door has been accomplished by a mechanical latch which holds the door in a closed position and which is released by a cable to allow the door to swing open under its own weight and the weight of the contents of the dipper. The door is relatched by allowing it to swing closed. An example of such a mechanical latch is found in U.S. Pat. No. 5,815,958 issued Oct. 6, 1998, for "Excavator Dipper Latch Assembly Having Removable Tapered Latch Bar".

The existing mechanical latching mechanisms are subjected to false door release due in part to rocks and dirt being lodged into the latchkeeper mechanism and the wearing away of the structure supporting the dipper door. The existing mechanisms are also subjected to non-release resulting from the mechanical elements failing to disengage properly. The existing mechanisms are further prone to excessive wear and resulting high maintenance costs and efforts.

Uncontrolled motion of the dipper door is currently restrained using snubber mechanisms. An example of such a snubber mechanism is found in U.S. Pat. No. 5,613,308 issued Mar. 25, 1997, for "Door Brake".

SUMMARY OF INTENTION

According to the invention, a dynamically active mechanism is used to control the opening of the door. The dynamically active mechanism may also control the door opening speed and may be dynamically active to close the door. It therefore replaces both the mechanical latching and snubber mechanisms currently in use.

The dynamically active mechanism may take the form of a brake or clutch centered at the dipper door hinge point. The dynamically active mechanism may also take the form of a linkage between the dipper and dipper door that is controlled by a linear actuator. A mechanical interlock, such as a spline, key, or sprag, can be engaged and disengaged while the dipper door is static. The dynamically active mechanism is then used to allow the dipper door to move to an open position.

The advantages of a mechanism according to the present invention are that it is capable of holding the dipper door shut under all digging and dumping conditions, it is capable of slowing or stopping the door in any position to allow partial opening or to facilitate "metered dumping" into a haul truck or other materials transport device, and the exactness of the closed position of the door is not critical since the dipper can be used with the door in any position.

The mechanism according to the present invention maintains the door safely closed during all digging and material transferring operations, allows rapid opening of the dipper door under machine operator's control, allows metered dumping under machine operator's control, and retains the ability to have the door close automatically in a safely latched position.

The foregoing and other objects and advantages of the invention will appear in the detailed description which follows. In the description, reference is made to the accompanying drawings which illustrate preferred embodiments of the invention.

DETAILED DESCRIPTION OF THE PREFERRED EMBODIMENT

Figure 1:
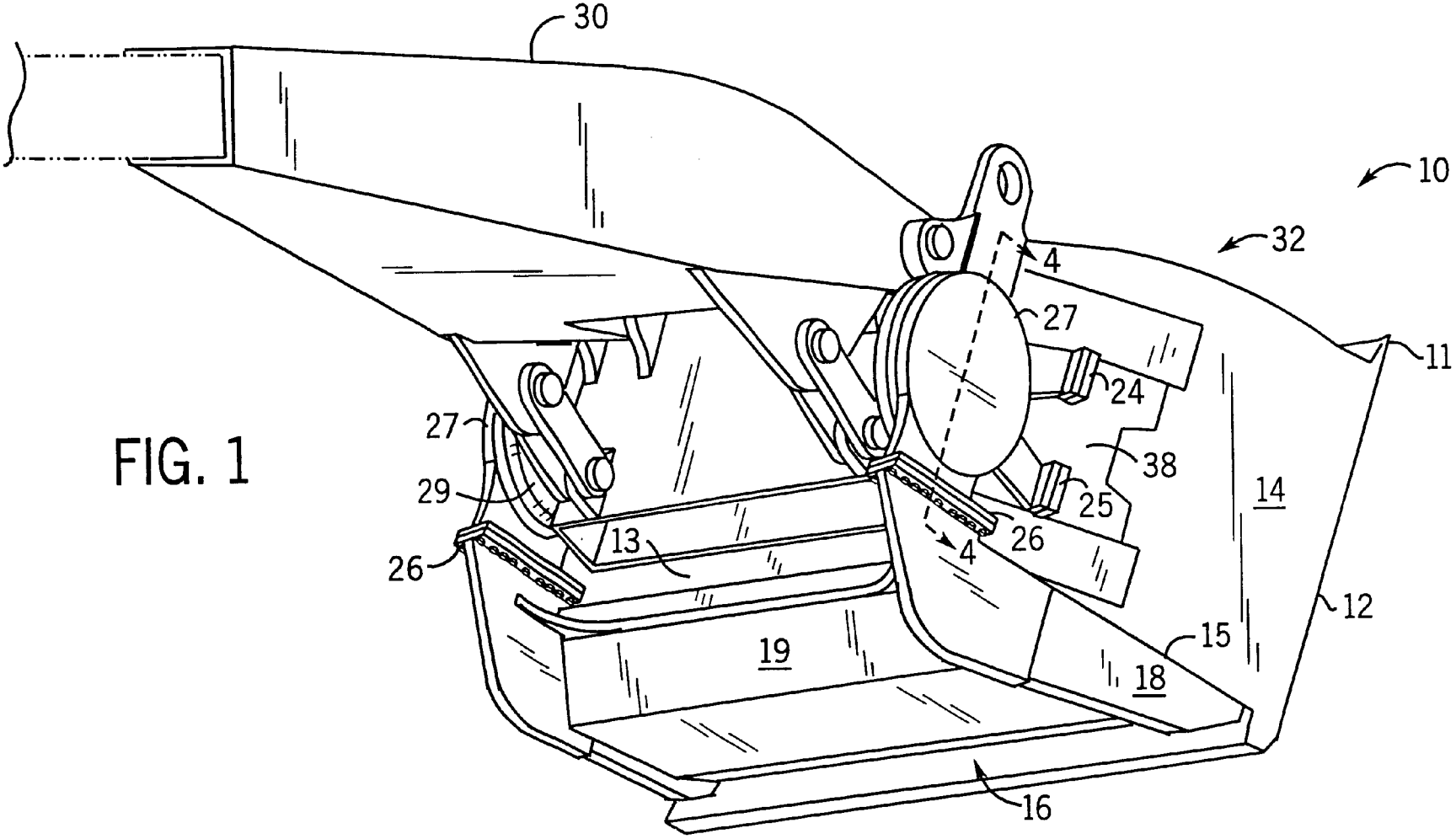
FIG. 1 is a perspective view in elevation of a dipper and dipper door with a brake in the hinge connection between the two.
Figure 2:
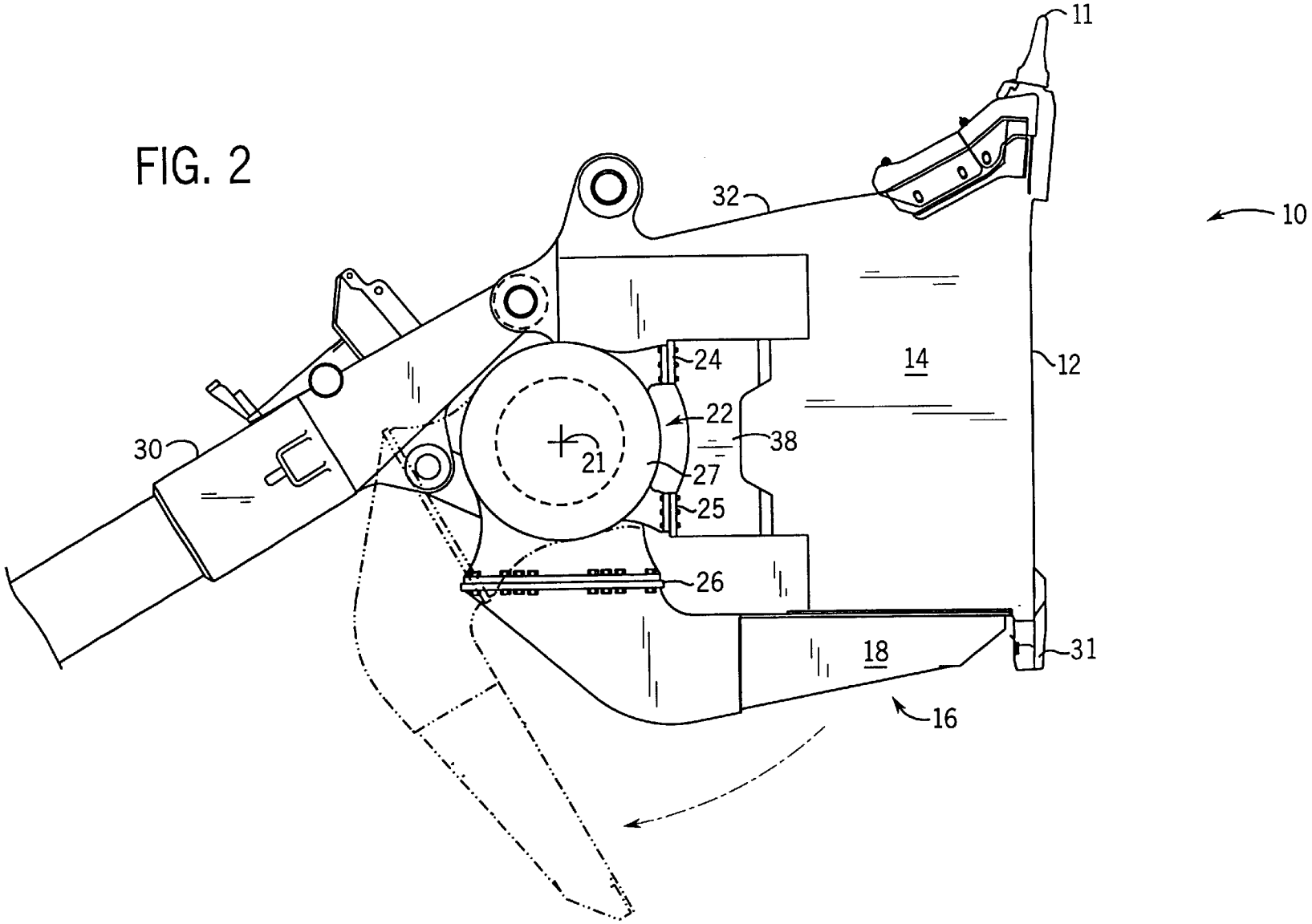
FIG. 2 is side view in elevation of the dipper of FIG. 1.
Figure 3:
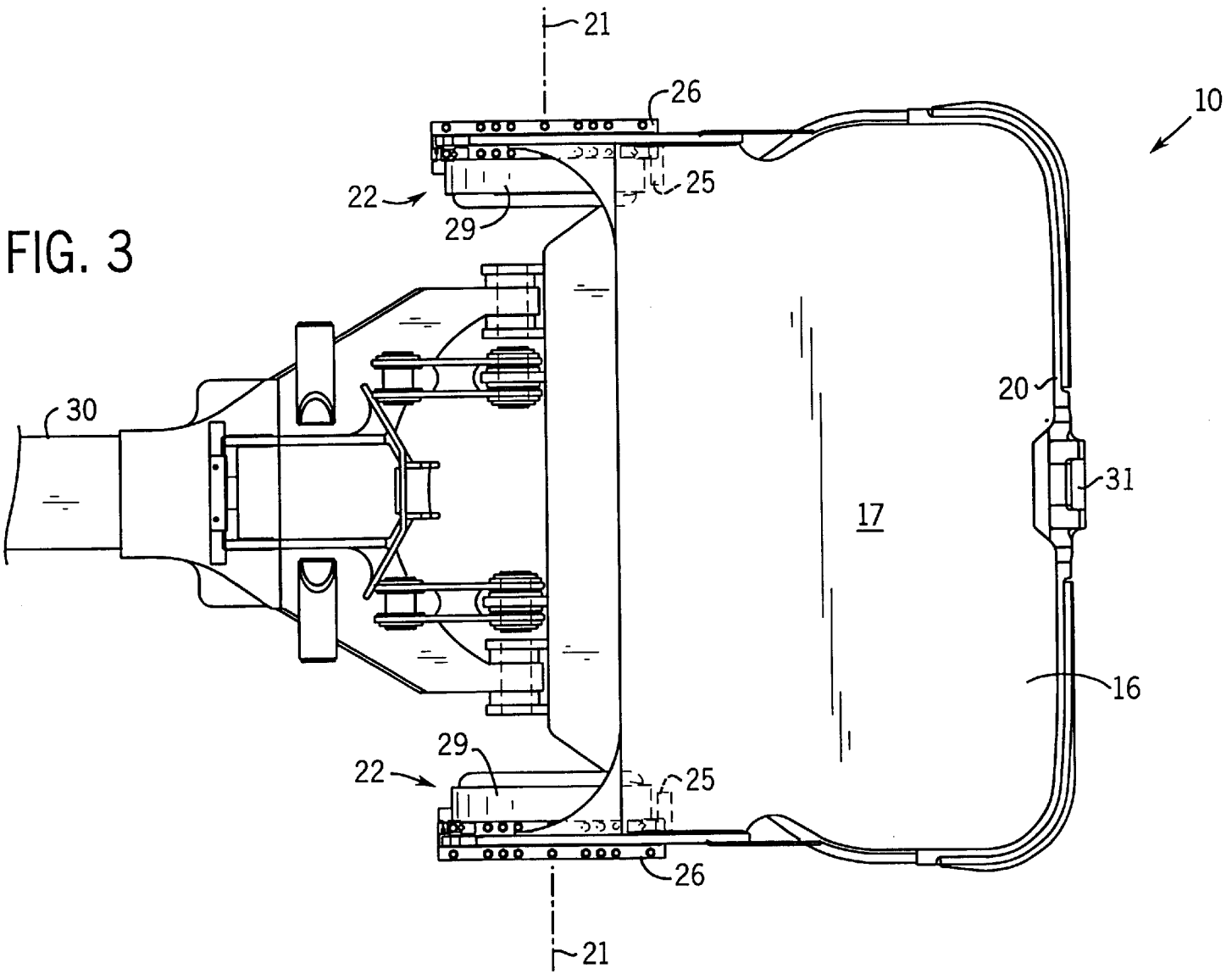
FIG. 3 is a bottom view of the dipper of FIG. 1.

Referring to FIGS. 1–3, a dipper 10 is pivotally mounted to an end of a dipper arm 30, and has an open forward end 32 with forwardly projecting teeth 11. As is known, the dipper 10 has a front wall 12, a back wall 13, and side walls 14. The bottom 15 of the dipper 10 is open but may be closed by a dipper door 16. The dipper door 16 is controlled by a pair of brakes 22 pivotally linking the door 16 to the dipper 10. Lugs 24, 25 extend from each of the dipper side walls 14 for mounting one of the brakes 22 thereto. The lugs 24, 25 can be joined to a steel plate 38 which is joined to the dipper door side wall 14, such as by welding, to simplify installation in the field.

The dipper door 16 is pivotally connected to the dipper 10, and in a closed position closes the dipper open bottom 15. The door 16 includes a bottom wall 17 which closes the dipper bottom 15 in the closed position. Opposing side walls 18, a front wall 20, and a back wall 19 are joined to edges of the bottom wall 17. Preferably, in the closed position, the dipper door side front, and rear walls 18, 20, 19 abut bottom edges of the dipper side, front, and rear walls to close the dipper bottom. A flange 26 extending from each dipper door side 18 is adapted for connecting to a rotatable outer housing 27 of one of the brakes 22.

The brakes 22 can take the form of an internal expanding, external contracting, or axial compressing type brake or clutch. Preferably, each brake 22 includes the rotatable outer housing 27 joined to one of the dipper door flanges 26, and an inner housing 29 rigidly fixed to the dipper lugs 24, 25. The outer housing 27 rotates about a pivot point 21 relative to the inner housing 29 to pivotally link the dipper door 16 to the dipper 10.

Figure 4:
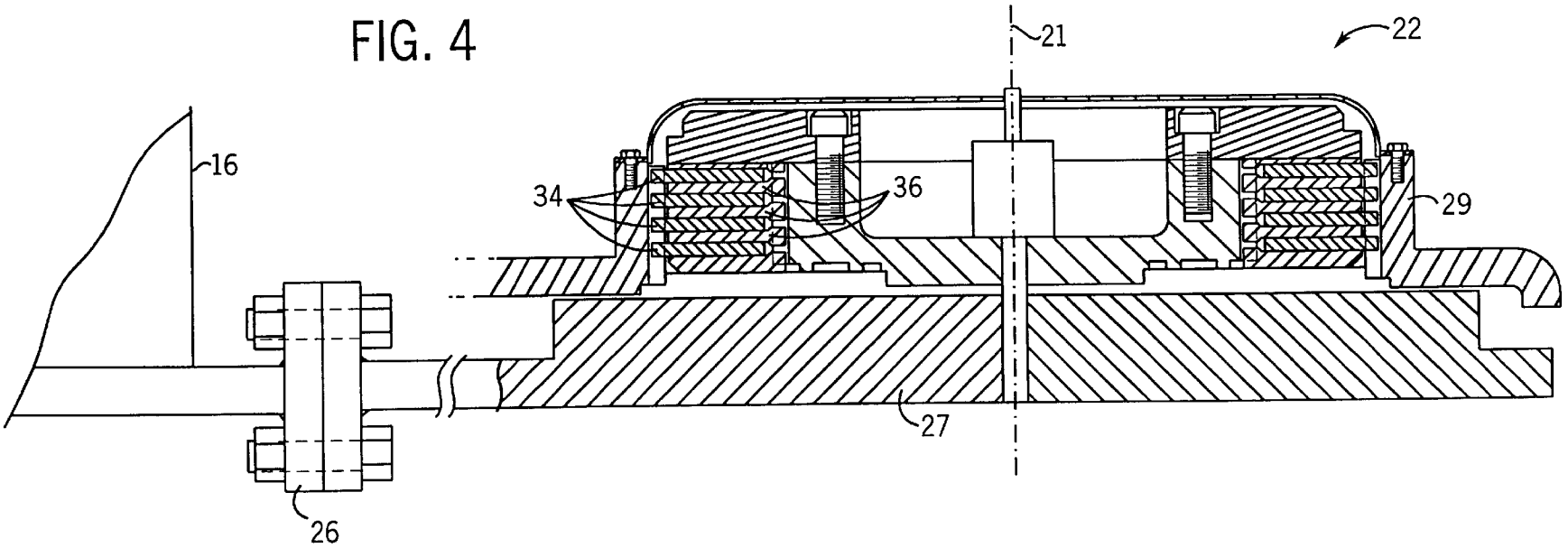
FIG. 4 is a cross sectional view along line 4–4 of FIG. 1.

Referring to FIG. 4, stationary plates 34 rigidly fixed to the inner housing 29 are interdigitated with plates 36 slidably mounted to the outer housing 27. Actuating the brake 22 causes the outer housing plates 36 to slidably move and contact the inner housing plates 34. The friction caused by the contacting plates inhibits movement of the outer housing 27 relative to the inner housing 29, and correspondingly inhibits movement of the dipper door 16 relative to the dipper 10. The brake or clutch 22 may be actuated pneumatically, hydraulically, electrically, mechanically, or the like without departing from the scope of the present invention.

Each brake 22 is disposed on opposing sides of the centerline of the dipper door 16, and the pivot points 21 of each brake are coaxial to define the dipper door pivot point. Advantageously, the brakes 22 can control the position of the dipper door 16 at any point in movement from closed to open position and back to closed position. However the dipper door 16 may also be allowed to swing open or closed automatically by virtue of its own weight as in prior latching systems.

Preferably, the dipper door pivot point defined by the brake pivot points 21 is offset a distance from the dipper bottom 15 in the direction of the dipper forward end 32. By providing a dipper door pivot point above the dipper bottom 15, the unload height of the dipper 10 is less than when the dipper door pivot point is at or below the dipper bottom 15.

The brakes 22 can be augmented by a mechanical lock 31 that holds the dipper door 16 in a closed position when it has been moved to that position. The mechanical lock 31 can operate by axial means such as a sliding spline, a key, or jaw. The mechanical lock 31 can also be an internal expanding mechanism, such as one using gear segments, pins, or sprags, or an external contracting means using the same elements.

Advantageously, the dipper door 16 can be retrofitted onto an existing dipper 10 by providing the necessary parts in a kit. For example, the door 16, brakes 22, and steel plate 38 including lugs 24,25 for attaching to the dipper can be provided as a kit.

The plate 38 is welded to the dipper 10, and the brakes 22 are attached to the lugs 24, 25 and door 16 to pivotally link the door 16 to the dipper 10.

Figure 5:
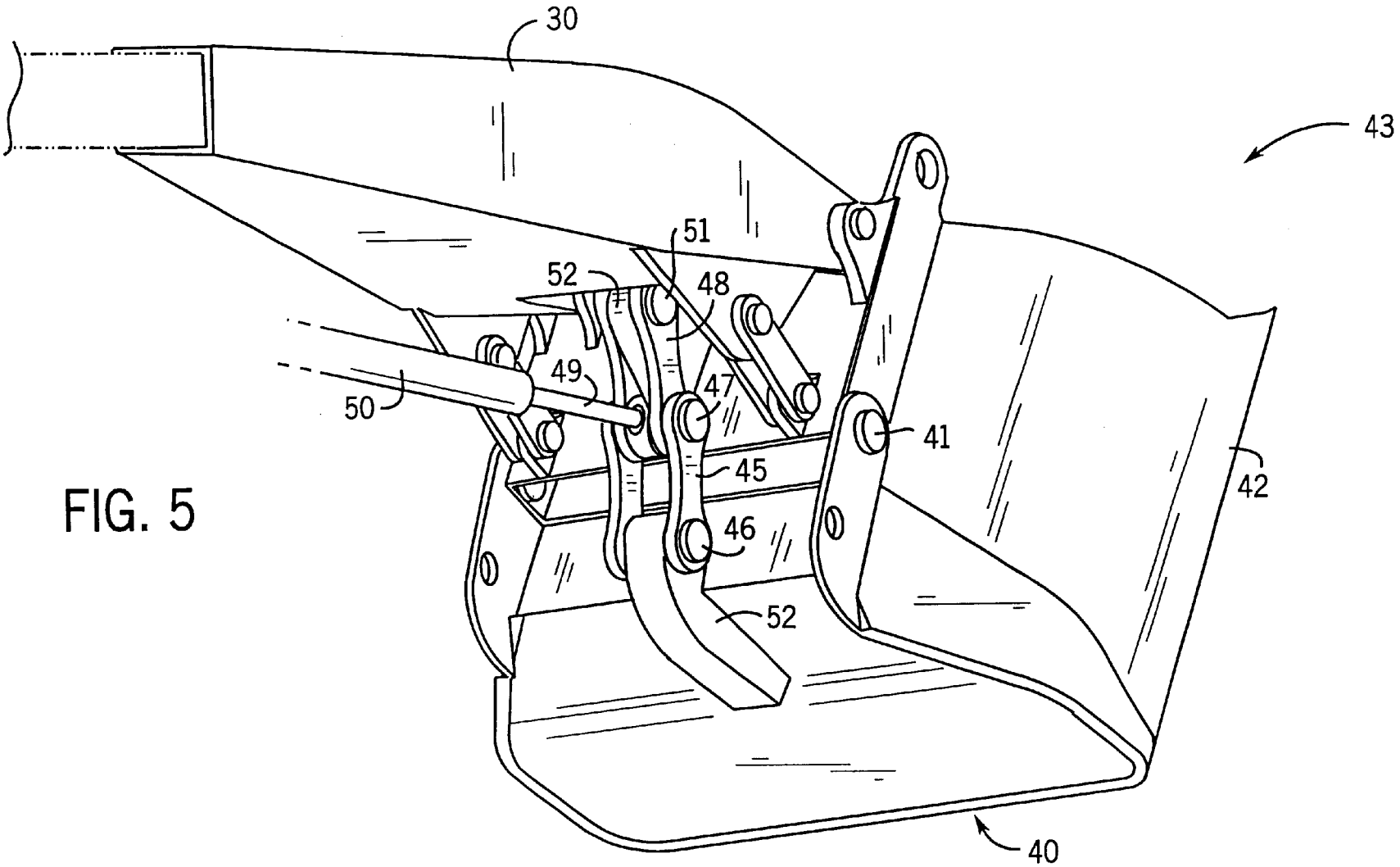
FIG. 5 is a perspective view in side elevation of a dipper, dipper door, and linkage mechanism according to a second embodiment of the invention.
Figure 6:
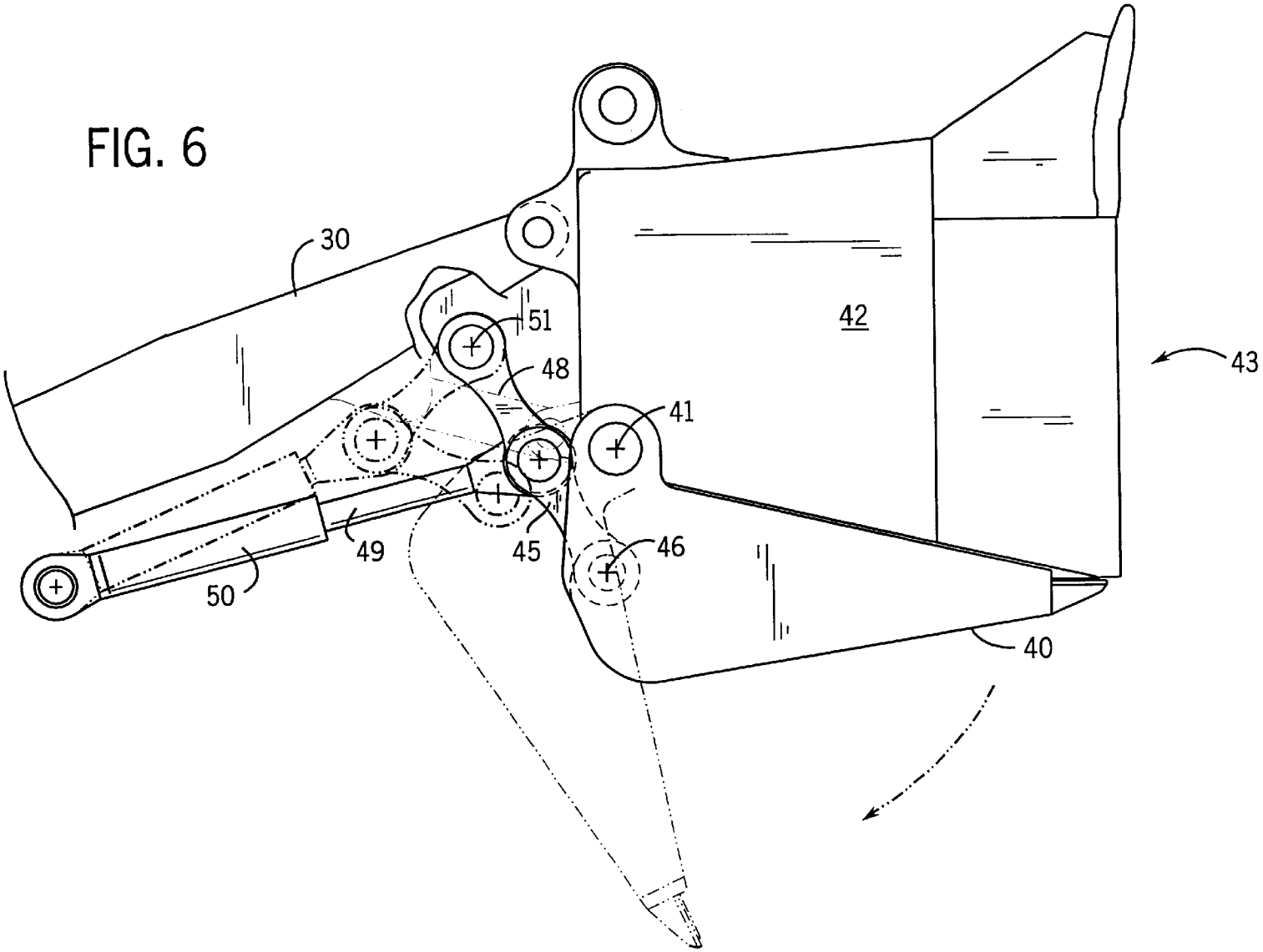
FIG. 6 is a side view in elevation of the dipper of FIG. 5.
Figure 7:
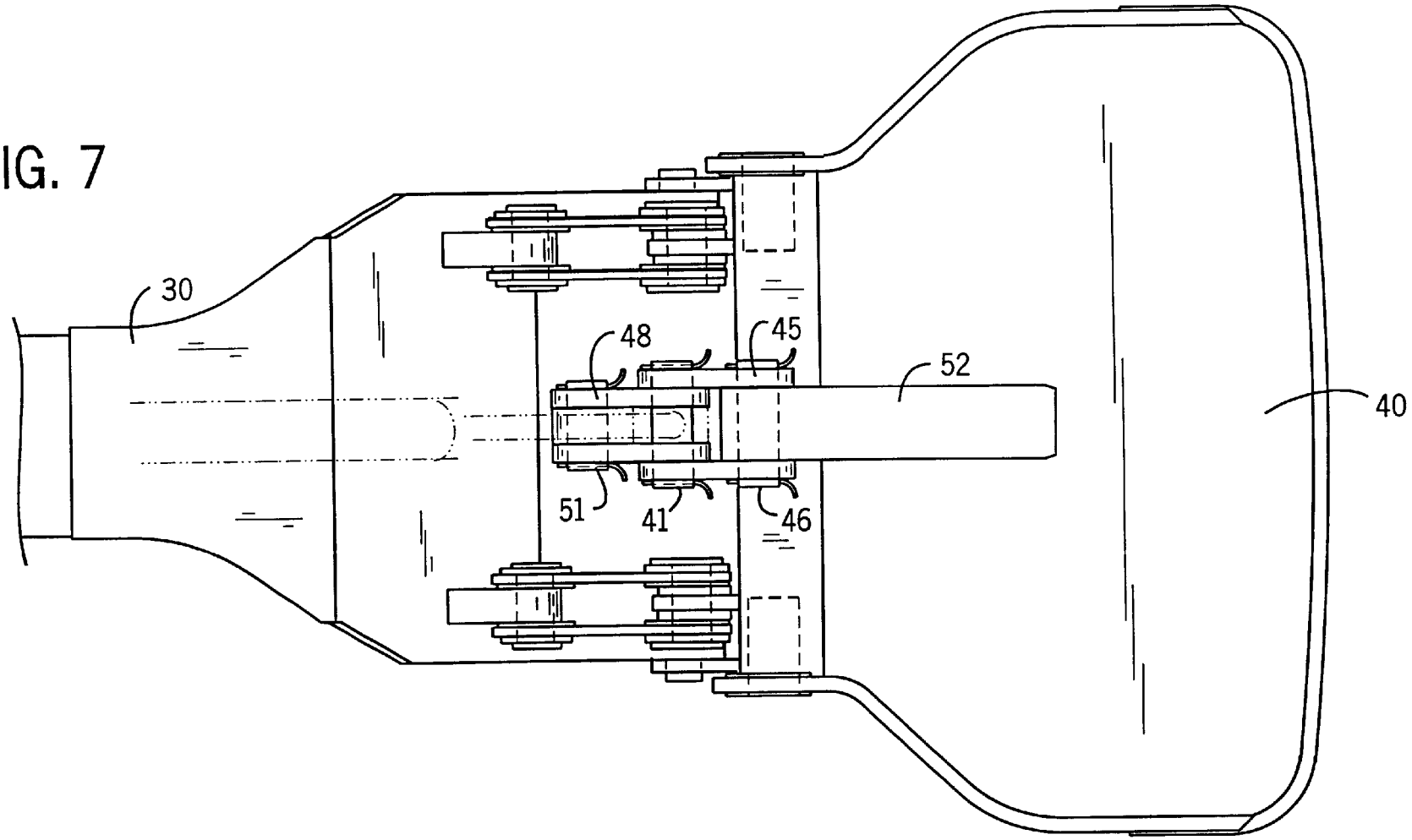
FIG. 7 is a bottom view of the dipper of FIG. 5.

Referring to FIGS. 5–7, a second embodiment of the dynamically active mechanism employs a linkage and a linear actuator instead of the rotary actuator 22 of the first embodiment. Specifically, a dipper door 40 is hinged at its rear end on a pivot 41 to the body 42 of a dipper indicated generally by the numeral 43. Of course, the embodiment shown in FIGS. 5–7 can also be provided as a kit for retrofitting to an existing dipper.

The linkage includes a first link 45 pivoted at a lower end on a pivot pin 46 attached to a lug 52 extending from the rear of the door 40. The opposite end of the link 45 is pivoted to a pivot pin 47 which also mounts a second link 48 and a rod 49 of a linear actuator, such as a hydraulic cylinder 50. The opposite end of the second link 48 is pivoted on a pin 51 held in a stationary support 52 on the dipper arm 30.

The linear actuator can be any commercially available actuator, such as the hydraulic cylinder 50 having a linear actuating rod 49. Preferably, the linear actuator includes the rod 49 mounted to the pivot point 47, and the cylinder 50 pivotally mounted to the dipper arm 30. Of course, the linear actuator could also be mounted such that the cylinder 50 is mounted to the pivot point 47, and the rod 49 is pivotally mounted to the dipper arm 30. In addition, although a hydraulic cylinder is disclosed, any form of linear actuator can be used in the embodiment of FIGS. 5–7 without departing from the scope of the invention.

In operation, retraction of the rod 49 by the cylinder 50 will cause the links 45 and 48 to collapse to the position shown in dashed-dot-dot-dashed lines in FIG. 6 with the result that the door 40 will be opened. As will be apparent, the door 40 can be stopped at any position between closed and open by proper actuation of the cylinder 50. The speed of the opening and closing of the door 40 can also be controlled by controlling the speed of actuation of the cylinder 50. When the rod 49 is extended from the cylinder 50, the links 45 and 48 will assume a position as shown in solid lines in FIG. 6. Preferably, in this position, the centerline of the pin 47 is slightly over center from a line between the centers of the pins 46 and 51.

While there has been shown and described what are at present considered the preferred embodiments of the invention, it will be obvious to those skilled in the art that various changes and modifications can be made therein without departing from the scope of the invention defined by the appended claims.

I claim:

1. A dipper assembly comprising:

a dipper having an open bottom, an open top, and closed sides;

a door pivotally linked to said dipper, and having an open position and a closed position, wherein in said closed position, said door closes said dipper bottom;

a linear actuating mechanism linked to said door for controlling said door as it moves between said open and closed positions; and a linkage actuated by said linear actuating mechanism, said linkage including a first link having a first end and a second end, said first end being pivotally linked to said door and said second end being pivotally linked to one end of a second link and a rod of said linear actuator, said second link including said second link one end and an opposing end pivotally linked to a point fixed relative to said dipper, wherein actuation of said linear actuator controls said door as it moves between said open and closed positions.

2. The dipper assembly as in claim 1, in which said door is pivotally mounted to said dipper at a pivot point offset a distance from a plane defined by said open bottom in a direction toward said open top.

3. The dipper assembly as in claim 1, including a mechanical lock releasably locking said door in said closed position.

* * * * *